United States Patent [19]

Nagl

[11] 4,038,040

[45] July 26, 1977

[54] FLEXIBLE LATTICE-LIKE GRID STRUCTURE ETCHED FROM A METALLIC FOIL

[75] Inventor: Werner Nagl, Munich, Germany

[73] Assignee: Messerschmitt-Bolkow-Blohm GmbH, Munich, Germany

[21] Appl. No.: 618,933

[22] Filed: Oct. 2, 1975

[30] Foreign Application Priority Data

Oct. 5, 1974 Germany ..... 2447565

[51] Int. Cl.[2] ..... C23F 1/02

[52] U.S. Cl. ..... 428/596; 96/36; 156/644; 156/659; 204/19; 204/24; 245/2; 245/5; 343/914

[58] Field of Search ..... 29/183, 183.5, 191.6, 29/193, 193.5; 204/24, 19; 156/18; 245/2, 5

[56] References Cited

U.S. PATENT DOCUMENTS 2,902,305 9/1959 Poltorak ..... 29/193

FOREIGN PATENT DOCUMENTS 810,249 3/1959 United Kingdom ..... 29/183.5

*Primary Examiner*—Arthur J. Steiner

*Attorney, Agent, or Firm*—Toren, McGeady and Stanger

[57] ABSTRACT

A flexible fine lattice-like grid structure is formed by etching a metal foil printed with a pattern of intersecting webs crossing at junction points. The sections of the webs extending between the junction points have a length greater than the shortest between the junction points. The web sections between junction points can be curvilinear or made up of a plurality of angularly disposed rectilinear sub-sections. The shape and length of web sections can be varied to achieve different expansion limits in different directions.

6 Claims, 5 Drawing Figures

FLEXIBLE LATTICE-LIKE GRID STRUCTURE ETCHED FROM A METALLIC FOIL

SUMMARY OF THE INVENTION

The present invention is directed to a flexible fine lattice-like grid structure etched from a metal foil where the grid webs intersect at junction points and the lengths of the grid webs between the junction points is greater than the shortest distance between such points.

Metallic fine grid structures have been produced by etching openings of small dimensions into metal parts having a thickness up to about 1.5mm. Such contour etching is a chemical-mechanical erosion process. A photo-sensitive layer resistant to the etchant is applied to the surface of the metal part by immersion, spraying or rolling. After exposing the photosensitive layer to light, areas not covered by a stencil or pattern are hardened and are not removed during a subsequent rinsing operation. During the etching operation, some of the active medium contacts the covered area. This underetching is independent of the meterial, the etching depth, the etching method, the temperature and concentration of the active medium. A leveling of the flanks can be attained by making the stencil or pattern smaller by a compensating amount to be established or, respectively, making it larger in the case of larger contours (compare Lueger, "Lexikon der Technik", Volume 13, Precision Machining, Key-word "Etching"). There are many areas of technology which used etched metallic fine grid structures.

In such fine grid structures known in the past, the individual openings formed by the lattice-like grid structure are triangular, rectangular, polygonal, or a combination of these various configurations. Due to the straight grid sections of the webs which extend between individual junction points of the grid, such grid structures have little or no elasticity based mainly on the tensile elasticity of the material.

There are certain metallic fine grid structures which have a so-called flexibility. An example of such a grid structure is one in which the individual grid webs form rhombic shaped openings, that is, the grid structure has a rhombic lattice-like configuration. If an oppositely directed force couple acts on two parallel sides of a rectangular test section formed of such a rhombic grid structure, stretching or elongation of the grid in the direction in which force is applied occurs only with a simultaneous transverse contraction in the direction normal to the application or force. However, if such a grid structure were clamped in a rigid frame, the only elongation which would occur, if any, would be the elasticity of elongation resulting from the tensile elasticity of the material.

In antenna technology, for the construction of reflector surfaces on deployable or openable reflector antennas, a metallic fine grid structure is spread between curved struts and the like in a fan-like fashion so that an umbrella-like reflector results. The geometric form of such a reflector is usually that of a paraboloid or a hyperboloid, that is, a double curved surface. To obtain the surface precision required for such a reflector, a metallic fine grid structure which is three dimensionally elastically deformable is required to afford a double curved surface in a foil grid. As an example, a rubber membrane is three dimensionally elastically deformable.

With the etched metallic fine grid structures which have been known to date, it has not been possible to produce a doubly curved surface, such as a parabolic reflector for an antenna, with the required precision of the surface contour afforded by the elastic deformation of the grid alone.

Accordingly, in forming parabolic reflectors, two metal grids, formed as if knitted, have been used with one spread over the other on the inside and outside of the curved struts in a fan type arrangement. Bracing wires are arranged between the two grid planes which are connected at one end with the grid forming the reflector surface and at the other end with the grid spaced from it. The initial tension in these wires is adjusted so that the reflector surface has an exact paraboloid form (Stacy V. Beavse, "Knitted Antenna Solving Knotty Problems", Microwaves, March 1974, page 14).

However, the use of such constructions is costly both in time and material. Moreover, at the intersections formed by a friction locking arrangement, a constant electric conductivity must be provided. A desired elasticity in the grid plane is difficult to calculate because of the uncontrollable friction at the multiple wire contact points. Another disadvantage of such a construction is that the friction causes considerable damping upon grid deflection from the inoperative position, so that after each elastic movement of the structure forming the grid, an undefinable residual deflection relative to the original arrangement of the grid structure remains. This residual deflection is disadvantageous for all applications with doubly curved set theoretical geometrical surfaces. If in a woven or tricot type grid or lattice structure, the individual wires are interlaced in a loose manner so as to form curved lines between the individual intersecting junctions of the structure, a certain elasticity results normal to the plane of the structure, however, the above-mentioned disadvantages remain.

Therefore, it is the primary object of the present invention to provide a large area metallic fine lattice-like type or grid structure of the above-described type which can be produced in a simple manner and which presents in a spatially three dimensional form a calculable and controllable elasticity which is higher than the specific elasticity of the material used in forming the structure.

In accordance with the present invention, the grid or lattice-like structure is formed by the use of webs having a greater length in the plane of the grid structure than the shortest dimension between the intersections or junctions of the webs consituting the structure.

In one embodiment of the invention, the junctions of the webs forming the grid structure are arranged as the corners of equilateral triangles and the web sections connecting the junctions have a sinusoidal configuration.

In another embodiment of the invention the configuration of the web sections are characterized by being semicirculr and/or arcuate in shape.

To afford different degrees of elasticity in different directions, the web sections forming the grid structure between individual intersections or junctions have, in accordance with the present invention, different curvatures in the plane of the grid structure.

In accordance with an intended field of application. the metal foil used in forming the grid structure is a spring elastic or plastically deformable metal.

To achieve a large sized metallic fine grid structure, several individual grid sections can be joined together by spot welding the grid junctions or intersections located on the periphery of the grid sections.

By virture of the present invention it is possible to achieve the advantages that the metallic fine grid structure is elastically deformable in a three dimensional manner, such as a rubber membrane, and yet can be formed of a high-strength, temperature resistant metal such as a special steel, spring bronze, titanium and the like. The metallic fine grid structure of the invention further exhibits an elasticity calculable in advance as to degree and direction which is controllable and is substantially greater than the specific elasticity of the material used in forming the grid structure. Moreover, by varying the curvature of the web sections of the lattice-like or grid structure, a different elasticity in different directions can be provided.

Another advantage obtained when using a plastically deformable metal is that thin-walled doubly curved surfaces can be shaped.

The metallic fine grid structures of the invention can be produced at no great cost by using known etching methods. The flexibility of a grid structure can be varied simply by varying the etching pattern. Since friction surfaces do not occur within the grid structure of the invention, the structure possesses a uniformly good, definable electric conductivity. Accordingly, damage to the surface layer at the intersections of the grid webs is precluded. An advantageous application of the grid structure of the present invention is as a doubly curved surface for reflector antennas.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
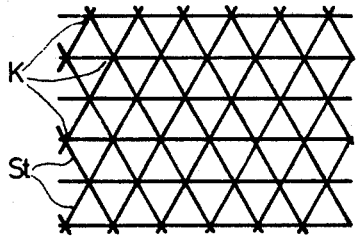
FIGS. 1 and 2 illustrate known metallic fine grid structures employing straight web sections forming the grid.

In the known metallic fine grid structure shown in FIG. 1, the web sections St extending between the junction points of the web are straight or rectilinear and the individual formed by the lattice-like structure have the form of an equilateral triangle. Due to this construction, elongation of the grid structure is possible only within the range of the tensile elasticity of the material used in forming the structure.

Figure 2:
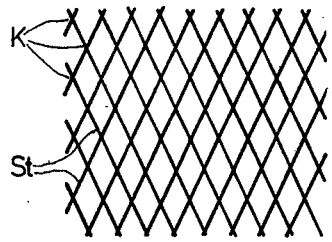

In FIG. 2 another metallic fine grid structure is shown having straight web sections St extending between the junction points K of the grid and forming rhombic-shaped openings in the lattice-like structure. Such structures have an elongation elasticity only in the direction of the diagonals of the openings in the grid structure and such elasticity is not limited to the tensile elasticity of the material, that is, an elongation of the structure in the direction of one diagonal is directly linked with a crosswise contraction in the direction of the corresponding second diagonal.

Figure 3:
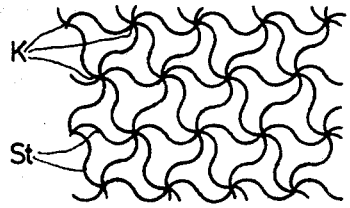
FIGS. 3, 4 and 5 display metallic fine grid structures in accordance with the present invention where the web sections have a greater length between web intersections or junctions than the shortest distance between such intersections or junctions.

FIG. 3 illustrates one embodiment of the invention where the junction points K of the grid structure form the corners of an equilateral triangle and the web sections St connecting such corners have a sinusoidal configuration.

Figure 4:
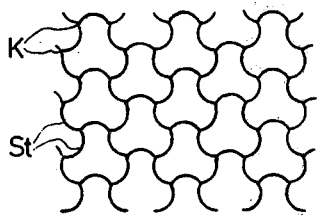

In FIG. 4 another embodiment is shown where the junction points K of the grid structure are connected by web sections St each having an arcuate configuration.

Figure 5:
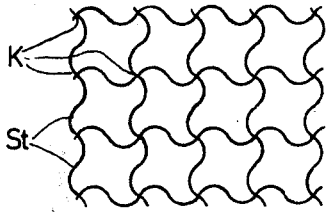

Still another embodiment of the invention is shown in FIG. 5 where the junction points K define the corners of a square and the web sections St connecting the corners have a sinusoidal configuration. This particular grid structure has a so-called mixed flexibility, since the elasticity in the orthogonal direction is less than in the diagonal direction. Because the intersections or junction points K of the grid structure are interconnected elastically by web sections St curved in the plane of the grid or lattice-like structure in a defined manner, an elastic bending deformation of the web section occurs when the distance between the junction points changes. By the selective formation of the web sections St with regard to their cross-sectional geometry and size as well as to their curvature, for example, having the shape of a sinusoidal line, the arc of a circle, a sawtooth line or a combination of such shapes, it is possible to obtain a mathematically predictable three-dimensional elasticity. Increased flexibility of such grid structures can be obtained by providing a greater curvature of the web sections.

Large sized metallic fine grid structures, such as required for reflector antennas in space travel or for the electromagnetic shielding of spaces, can be produced by the electric resistance welding or electron beam welding of individual sections of the grid structure.

However, the application of the metallic fine grid structure of the present invention is not limited to electrical engineering, rather, it is also useful in the automobile industry, for instance, ar reinforcement in belted tires, for thin safety glass or for the reinforcement of hardenable shaped parts used in body construction.

The metallic fine grid structure embodying the present invention constitutes a substitute for nearly all rubberized fabrics. It can be used as the base for a flexible skin sturcture in containers, bubble structures, floats, and in the textile and packaging industry. Anothe field of application of the invention is in the field of aviation and spaced travel in the production of highly heat-resistant brake shields for jet planes and other flight devices, such as reentry vehicles.

While specific embodiments of the invention have been shown and described in detail to illustrate the application of the inventive principles, it will be understood that the invention may be embodied otherwise without departing from such principles.

What is claimed is:

1. In a flexible matallic fine grid structure for antenna reflectors with a double curved surface with the grid structure comprising a plurality of web sections interconnected at junction points, said web sections being curved in the plane of the grid and the junction points of said web sections forming the corners of equilateral triangles, wherein the improvement comprises that said web sections being etched from a metal foil, said web sections connecting the junction points having a sinusoidal configuration for the extent of the web sections between junction points, and the ends of at least five web sections forming a junction point.

2. In a flexible metallic fine grid structure for antenna reflectors with a double curved surface with the grid structure comprising a plurality of web sections interconnected at junction points, said web sections being curved in the plane of the grid and the junction points of said web sections forming the corners of equisided, multi-sided closed sections, wherein the improvement comprises that said web sections being etched from a metal foil, said web sections connecting the junction points have a sinusoidal configuration over the extent of the web sections between the junction points.

3. Flexible metallic fine grid structure, as set forth in claim 2, wherein said multi-sided closed section is rectangular in shape.

4. Flexible metallic fine grid structure, as set forth in claim 1, wherein the metal foil forming the grid structure is a spring-elastic metal.

5. Flexible metallic fine grid structure, as set forth in claim 1, wherein the metal foil forming the grid structure is a plastically deformable metal.

6. Flexible metallic fine grid structure, as set forth in claim 1, wherein weldments are deposited at the peripheral junction points of contiguous grid structure sections for connecting said grid structure sections together.

* * * * *